United States Patent [19]

Hauser

[11] 3,937,455

[45] Feb. 10, 1976

[54] AUTOMATIC STACK FEED

[75] Inventor: Frank W. Hauser, Santa Monica, Calif.

[73] Assignee: Telautograph Corporation, Los Angeles, Calif.

[22] Filed: Apr. 1, 1974

[21] Appl. No.: 456,789

[52] U.S. Cl. ..... 271/10; 271/37; 271/110; 271/119; 271/120; 271/122

[51] Int. Cl.[2] ..... B65H 3/06

[58] Field of Search ..... 271/120, 119, 122, 125, 271/110, 37, 10

[56] References Cited

UNITED STATES PATENTS

| | | | |
|---|---|---|---|
| 1,262,383 | 4/1918 | Otarii et al. | 271/120 |
| 3,173,684 | 3/1965 | Binzoni et al. | 271/122 X |
| 3,545,742 | 12/1970 | Muller et al. | 271/122 X |
| 3,580,566 | 5/1971 | Vasse | 271/110 |
| 3,630,516 | 12/1971 | Hong | 271/120 X |
| 3,795,395 | 3/1974 | Ramson et al. | 271/119 X |

FOREIGN PATENTS OR APPLICATIONS

| | | | |
|---|---|---|---|
| 1,205,113 | 11/1965 | Germany | 271/119 |

*Primary Examiner*—Evon C. Blunk
*Assistant Examiner*—Bruce H. Stoner, Jr.
*Attorney, Agent, or Firm*—Lindenberg, Freilich, Wasserman, Rosen & Fernandez

[57] ABSTRACT

Apparatus for feeding individual sheets from a hopper, including a rotating prefeed member positioned near the exit end of the hopper and having projections for repeatedly beating the next sheet to be fed from the stack of sheets, to help separate the sheets and to urge the next sheet out of the hopper.

2 Claims, 3 Drawing Figures

Fig. 2
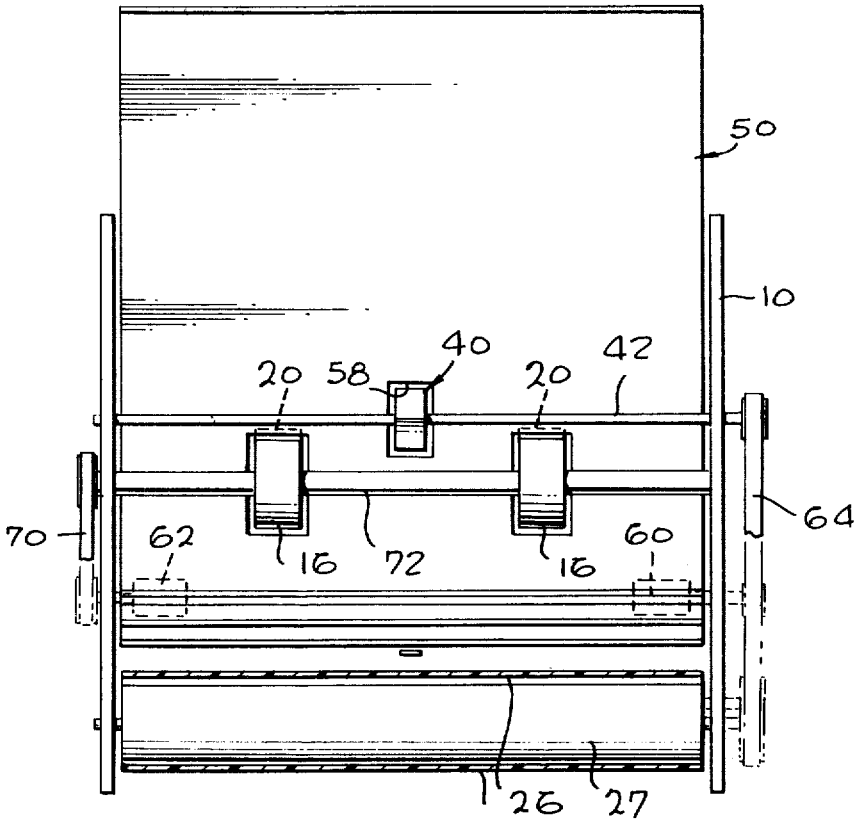
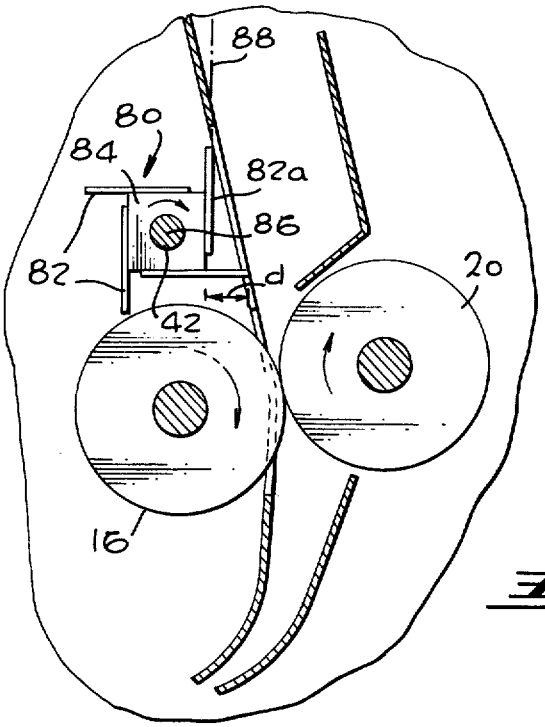
Fig. 3

AUTOMATIC STACK FEED

BACKGROUND OF THE INVENTION

This invention relates to paper feeding mechanisms. A relatively slow but highly reliable paper feeding mechanism is required in one type of facsimile transmitter which has a hopper for holding stack of sheets and which feeds the sheets one at each time into a scanner. The hopper can be oriented in a largely vertical direction, and rollers at the bottom of the hopper can engage one sheet at a time to feed it to the scanner. A paper feeding mechanism of this general type is described in detail in U.S. Pat. No. 3,545,742 issued Dec. 8, 1970 to the assignee of the present patent application. One type of problem that sometimes arises with this type of feeding mechanism is that a pair of sheets may tend to stick together, which can prevent the bottommost sheet from dropping against a feed roller, or which can cause two sheets to be fed even though a separation roller is provided to reduce this possibility. Sheets can tend to stick together where there is a high humidity or where the sheets have a static electric charge as where they are Xerox or other electrostatic type copies. A simple device that reduces the possibility of sheets sticking together so as to prevent the feeding of no sheet or the feeding of two sheets at once, would increase the reliability of the feeding mechanism.

SUMMARY OF THE INVENTION

In accordance with one embodiment of the present invention, a simple mechanism is provided which helps to maintain the sheets in a stack separated from one another and which also helps to feed the sheets out of the hopper and into sheet-engaging rollers. The mechanism includes a rotating prefeed member which has projections for repeatedly beating the sheets in a hopper. The prefeed member is utilized in conjunction with a paper feeding mechanism which includes a hopper oriented at a slight incline from the vertical and having a narrowing lower portion or throat through which sheets fall and where they are grasped by feed rollers. The hopper has a lower side plate, and the periphery of the prefeed member extends through a slot formed in the lower side plate at a location near the throat of the hopper. As a result, the beating action tends to bend the sheets which have partially passed through the throat, to help separate them, and it also urges the lowermost sheet downwardly into the feed rollers. The prefeed member can be formed with a square cross-section so that the corners of the square form projections for beating the sheets. In another arrangement, the prefeed member has four rubber blades that deflect against the sheets as the prefeed member rotates.

The novel features that are considered characteristic of this invention are set forth with particularity in the appended claims. The invention will best be understood from the following description when read in connection with the accompanying drawings.

BRIEF DESCRIPTION OF THE DRAWINGS

FIG. 2 is a view taken on the line 2—2 of FIG. 1; and

FIG. 3 is a sectional side view of a feed mechanism constructed in accordance with another embodiment of the invention.

DESCRIPTION OF THE PREFERRED EMBODIMENTS

Figure 1:
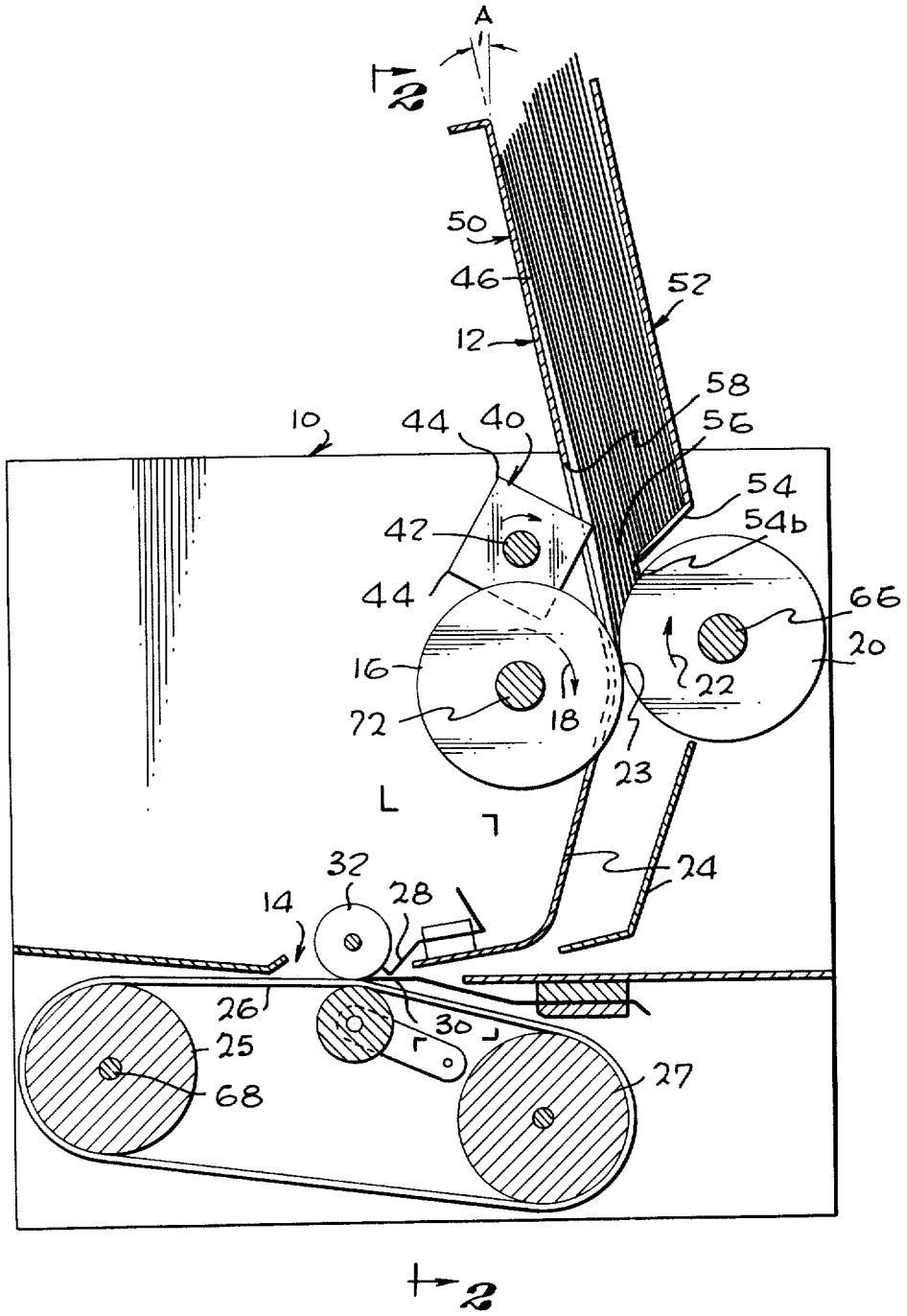
FIG. 1 is a sectional side view of a feed mechanism constructed in accordance with the present invention.

FIGS. 1 and 2 illustrate a portion of a facsimile transmitter which includes a frame 10 with a hopper 12 for receiving a stack of sheets of paper. Each of the sheets carries an image, and the sheets are fed one at a time along a path past a scanning aperture 14 where the image is read and transmitted. The paper feeding mechanism includes a pair of feed rollers 16 positioned near the bottom of the hopper, which rotate intermittently in the direction of arrow 18 to feed individual sheets out of the hopper. A pair of reverse rollers 20 are positioned opposite the feed rollers so that a nip 23 is formed between them to receive sheets. The reverse rollers, however, rotate continuously in the direction of arrow 22 to help separate the sheets so that only one sheet at a time is fed out of the hopper. As each sheet is fed by the feed rollers 16, the sheet passes around a pair of guides 24 and onto a belt 26 that rotates on a pair of belt rollers 25, 27 and which carries the sheet past the scanning aperture 14. As soon as the sheet passes between a pair of contacts 28, 30 to indicate that the leading edge of the sheet has reached the belt and is engaged between the belt and a pressure roll 32, the feed rollers 16 are no longer driven, although they are allowed to idle or be freely turned as the rearward portion of the sheet is pulled across them.

The facsimile transmitter is left unattended for extended periods of time while the sheets are individually moved past the scanning aperture, inasmuch as it typically requires about three minutes to transmit the image on each sheet. One of the problems that sometimes arises is that the sheets in the stack may tend to stick together, so that two or more sheets may be fed together past the feed rollers 16. The reverse rollers 20 rotate in a direction to tend to move any sheet of paper which starts to pass by it, back into the hopper 12. The reverse rollers 20 are preferably constructed of a material with a lower coefficient of friction on paper than the feed rollers 16 on the paper, but with a coefficient greater than that between two sheets of paper. The reverse roller 20 rotates slowly but continuously in the indicated direction to return any sheet that slips thereby back into the hopper. While the reverse roller helps to prevent double feeding, double feeding of sheets still occurs. This can occur, for example, when the sheets have electrostatic charges which may result when the sheets are electrostatic copies, or where the sheets have been stored in an area of high humidity so that the moisture may tend to stick them together.

In accordance with the present invention, a prefeed member 40 is provided which helps to keep the sheets separated so that one and only one sheet at a time is fed through the machine. The prefeed member 40, which is mounted on a rotatable shaft 42, is of square cross-sectional shape, so that it forms four projections 44 at the corners of the square. The prefeed member is mounted so that these projecting portions 40 extend into the hopper and against a lowermost sheet 46 therein at a position up-path from the feed rollers 16. As the prefeed member rotates, it slowly deflects or "beats" the stack of sheets, and particularly the lowermost sheet thereof. This slow beating action causes a repeated bending of the stack of sheets, which tends to cause a slight sliding of the sheets on one another. This bending of a stack of sheets is the type of action generally recommended when a stack of sheets is laid in a copier or other sheet-using device, to help minimize sticking of the sheets to one another. The continuously rotating prefeed member 40 serves to perform this bending action while the sheets are in the hopper so that even if the machine operates in a region of high humidity, any sticking sheets tend to be repeatedly separated. The prefeed member 40 also helps to feed the lowermost sheet 46 of the stack into the feed rollers 16, as the corners of the prefeed member brush against the sheet.

The hopper 12 includes a pair of side plates 50, 52 between which the stack of sheets is confined, with the uppermost side plate having a bent lower end 54 that forms a throat area 56 through which the sheets pass before they reach the feed rollers 16. The lower side plate 50 is formed with an aperture 58 through which the projecting portions of the prefeed member 40 can extend, so that the stack of sheets can be bent by the prefeed member while the stack is in the hopper. In order to encourage feeding, the hopper 12 is oriented in a primarily vertical direction. However, the hopper, and particularly the lower side plate 50 thereof, is oriented at an angle A of at least a few degrees, and normally less than 45°, away from the vertical in order to encourage the next sheet 46 to lie against the side plate 50 through which the prefeed member projects. It may be noted that the prefeed member 40 lies near the bottom of the stack holder, at a position immediately above the throat 56. This helps to encourage bending of the sheets, because when the prefeed member 40 moves against the sheets, the sheets cannot merely move away, but are forced to bend because the bottom **54*b* of the bent upper plate at the throat 56** backs up the sheets.

The facsimile scanner includes two motors indicated at 60 and 62, which drive the various rotating elements of the machine. One of the motors 60 rotates continuously and is coupled by a transmission belt 64 to sprockets that are fixed to the shafts of various elements, including a sprocket fixed to the shaft 42 of the prefeed member 40, the shaft 66 on which the reverse rollers 20 are mounted, and a shaft 68 which is fixed to one of the belt rollers 25. The other motor 62 is coupled by a belt to a sprocket on the shaft 72 of the feed rollers 16. The motor 62 is energized only when a sheet lies between the contact 28, 30, which indicates that a new sheet is ready to be received on the belt 26 and at the scanning aperture 14. Thus, the prefeed member 40 continuously rotates to beat the sheets in the stack holder to minimize the possibility of sticking and to repeatedly urge the bottommost sheet towards the feed rollers, so that whenever a new sheet is required, a single sheet is provided for immediate grasping by the feed roller.

FIG. 3 illustrates another embodiment of the invention wherein the prefeed member 80 includes four resilient blades 82 mounted on a support 84 that is rotatably driven in the same manner as the prefeed member 40 described above. The support 84 has four edges, and each blade 82 is mounted on a different one of the edges. Each blade extends away from the support by a distance d much greater than the thickness of the blade, so that the blade can readily bend to prevent damage to the stack of sheets in the hopper. The blades 82 are preferably constructed of an elastomeric material such as rubber, so that they have a high friction against the paper sheets to urge them towards the feed rollers 20, a high flexibility to readily bend, and a low hardness to minimize the possibility of tearing the sheets in the hopper. The blades are mounted so they extend away from the support primarily in a circumferential direction and opposite to the direction of rotation; that is, so that each blade extends along an imaginary line, such as line 88 for blade **82*a*, that does not pass close to the axis of rotation 86 or even through the shaft 42**. This allows each blade to contact the bottommost sheet along a large length of the blade, to provide a large contact area.

Thus, the invention provides an improved sheet feeding apparatus which minimizes the possibility of sheets sticking to one another, which could lead to the feeding of double sheets or of no sheet, and which also helps to feed sheets into subsequent feed rollers that then move the sheet out of the stack. This is accomplished by beating means which repeatedly deflects the next sheet to be fed so as to bend the stack of sheets to encourage relative sliding and therefore separation, and which also urges the next sheet towards the feeding rollers. The stack holder is oriented at an angle of at least a few degrees from the vertical so that the next sheet to be fed lies on a bottom side plate of the holder, and the prefeed member extends through a slot near the lower end of the bottom side plate so that it extends into the region normally occupied by the stack of sheets. The prefeed member is a rotatably mounted element with at least one projection for beating the stack of sheets as the member rotates. The stack holder is formed with a narrowing or throat portion at its lower end, and the prefeed member is rotatably mounted immediately above this throat area, to provide a substantial bending of the sheets as it beats the lowermost sheet of the stack.

Although particular embodiments of the invention have been described and illustrated herein, it is recognized that modifications and equivalents may readily occur to those skilled in the art and consequently, it is intended that the claims be interpreted to cover such modifications and equivalents.

The embodiments of the invention in which an exclusive property or privilege is claimed are defined as follows:

1. Apparatus for feeding individual sheets from a stack comprising:

a hopper having a lower side plate (50) extending at an angle of at least a few degrees and less than 45° from the vertical and having a slot near its lower end, said hopper having an upper plate with a lower end (54) which extends towards said lower plate but which has an end (**54*b*) spaced therefrom to form a throat (56**) at the bottom of the hopper through which only a portion of the sheets of a full hopper can pass;

feed roller means (16) positioned below said throat and activatable to move individual sheets along a predetermined feed path leading from said hopper means;

a prefeed member (40) with at least one projection, said prefeed member being rotatably mounted with its projection passing through said slot in said lower side plate to beat against a bottom sheet in the hopper;

said prefeed member located immediately above said throat (56) to lie substantially opposite said lower end (54) of the upper plate, whereby the prefeed member tends to bend primarily the few sheets that have passed through the throat rather than uniformly bending the entire stack of sheets.

2. The apparatus described in claim 1 wherein:

said prefeed member includes a support having a plurality of blades of elastomeric material extending therefrom to form said projection, each blade extending primarily circumferentially and extending away from the support in a direction opposite to the direction of rotation of the prefeed member.

* * * * *